United States Patent [19]

Dragone

[11] Patent Number: 4,468,672

[45] Date of Patent: Aug. 28, 1984

[54] WIDE BANDWIDTH HYBRID MODE FEEDS

[75] Inventor: Corrado Dragone, Little Silver, N.J.

[73] Assignee: Bell Telephone Laboratories, Incorporated, Murray Hill, N.J.

[21] Appl. No.: 315,670

[22] Filed: Oct. 28, 1981

[51] Int. Cl.[3] ..... H01Q 13/02

[52] U.S. Cl. ..... 343/783; 343/785; 333/240

[58] Field of Search ..... 343/785, 786; 333/240

[56] References Cited

U.S. PATENT DOCUMENTS

| | | | |
|---|---|---|---|
| 2,801,413 | 7/1957 | Beck | 343/785 |
| 3,605,101 | 9/1971 | Kolettis et al. | 343/783 |
| 3,618,106 | 11/1971 | Bryant | 343/772 |
| 3,858,214 | 12/1974 | Jones | 343/785 |
| 4,021,814 | 5/1977 | Kerr et al. | 343/786 |
| 4,040,061 | 8/1977 | Roberts et al. | 343/786 |
| 4,231,042 | 10/1980 | Turrin | 343/786 |
| 4,246,884 | 1/1981 | Noerpal | 343/786 |

FOREIGN PATENT DOCUMENTS

| | | | |
|---|---|---|---|
| 29350 | 1/1977 | Japan | 343/735 |
| 25545 | 2/1977 | Japan | 333/240 |
| 116865 | 8/1979 | Japan | 333/240 |
| 761659 | 11/1956 | United Kingdom | 333/98 |
| 867356 | 5/1961 | United Kingdom | 343/785 |

OTHER PUBLICATIONS

Dragone; Reflection Transmission . . . in a Corrugated Feed, BSTJ, vol. 56, No. 6, Jul.-Aug. 1977, pp. 835-867.

Dragone; Characteristics of a Broadband Microwave Corrugated Feed; BSTJ, vol. 56, No. 6, Jul.-Aug. 1977, pp. 869-888.

Carpenter; A Dual-Band Corrugated Feed Horn; IEEE AP-S Symp., vol. I, Quebec, Can., 1980, pp. 213-216.

*Primary Examiner*—Eli Lieberman

*Attorney, Agent, or Firm*—Erwin W. Pfeifle

[57] ABSTRACT

The present invention relates to hybrid mode feeds which are capable of handling very wide bandwidths. In the present feed arrangements, a dominant $TE_{11}$ mode is converted to the $HE_{11}$ hybrid mode which is then launched. The $TE_{11}$ to $HE_{11}$ mode conversion is achieved by inserting a circular dielectric rod (12) into a flared end (11) of a smooth-walled cylindrical feedhorn until a small cylindrical section of the dielectric rod engages with the inner wall (15) of the unflared portion of the feedhorn. In one feed arrangement, the other end of the dielectric rod is similarly inserted into a flared end (21) of a corrugated cylindrical feedhorn section (22) until a short longitudinal section of the cylindrical portion of the rod is concentric with the corrugations of an unflared section of the feedhorn to provide a transition for the $HE_{11}$ mode into the corrugated waveguide for subsequent launch. In a second feed arrangement, the dielectric rod at the aperture of the smooth-walled flared feedhorn is flared outward to end in a curved configuration which is shaped to minimize reflections back into the dielectric rod and provide a predetermined wavefront at the aperture of the feed.

7 Claims, 4 Drawing Figures

WIDE BANDWIDTH HYBRID MODE FEEDS

BACKGROUND OF THE INVENTION

1. Field of the Invention

The present invention relates to wide bandwidth hybrid mode feeds and, more particularly, to hybrid mode feeds which are capable of handling very wide bandwidths and include an arrangement which converts a dominant $TE_{11}$ mode at the input to the feed into the $HE_{11}$ hybrid mode, which hybrid mode is then propagated further or launched into free space.

2. Description of the Prior Art

An important consideration in designing antennas for terrestrial radio relay and satellite communication is excellent radiation characteristics and very low return loss. In this regard the horn reflector is an excellent antenna, but its metal walls are generally uncorrugated. The horn antenna could be improved with corrugations but generally corrugated structures, especially in the size of the horn reflector, are very difficult and expensive to produce. Additionally, the −40DB return loss over a very wide range of frequencies as found with the present uncorrugated horn reflectors is generally not obtainable with the present corrugated feeds.

U.S. Pat. No. 4,040,061 issued to C. G. Roberts et al on Aug. 2, 1977 describes a corrugated horn antenna allegedly having a useful operating bandwidth of at least 2.25:1. There, the antenna is fed with a waveguide in which a $TM_{11}$ mode suppressor is disposed in a circular waveguide section before the input wavefront encounters a flared corrugated horn. The mode suppressor functions to prevent the excitation of hybrid modes in the horn at the upper end of a wide band of frequencies which would cause an unacceptable deterioration in the radiation pattern.

U.S. Pat. No. 4,021,814 issued to J. L. Kerr on May 3, 1977 relates to a broad-band corrugated horn antenna with a double-ridged circular waveguide feed allegedly having a bandwidth handling capability greater than 2:1 without the introduction of lossy materials or resistive type mode suppressors. There, a plurality of ridges, each having a predetermined width, and a plurality of gaps between the ridges, with each gap having a predetermined width, are provided wherein the width of the gaps is greater than the width of the ridges.

It has been found that for a waveguide with finite surface impedances, the fundamental $HE_{11}$ mode approaches, under certain conditions the behavior that the field essentially vanishes at the boundary and the field is essentially polarized in one direction. Because of these properties, such a mode is useful for long distance communication since it is little affected by wall imperfections or wall losses and provides an ideal illumination for a feed for reflector antennas. In general, it is difficult to excite the $HE_{11}$ mode in a corrugated feed since, at the input, the feed is usually excited by the $TE_{11}$ mode of a circular waveguide with smooth metal walls. For the $TE_{11}$ mode, the transverse wavenumber, $\sigma$, is related to the waveguide radius by $\sigma a = 1.84184$. At the feed aperture, however, for the desired $HE_{11}$ mode, $\sigma a \simeq 2.4048$. Thus the mode parameter $u = \sigma a$ must increase from 1.84184 to about 2.404 as the mode propagates from the input of the feed to the aperture.

In a corrugated waveguide, u is known to be a decreasing function of the corrugations depth d. Therefore, in order for u to increase, d must decrease in the direction of propagation. To satisfy this requirement, corrugated feeds are usually designed as shown in FIGS. 1 and 2*a* of U.S. Pat. No. 3,618,106 issued to G. H. Bryant on Nov. 2, 1971. In this regard, see also the articles "Reflection, Transmission and Mode Conversion in a Corrugated Feed" by C. Dragone in *BSTJ*, Vol. 56, No. 6, July–August 1977 at pp. 835–867 and "Characteristics of a Broadband Microwave Corrugated Feed: A Comparison Between Theory and Experiment" by C. Dragone in *BSTJ*, Vol. 56, No. 6, July–August 1977, at pp. 869–888. In such arrangement, the input discontinuity of d causes a reflection which vanishes at the frequency satisfying $\lambda_r \simeq 2d$, where $\lambda_r$ is the wavelength in the radial lines of the input corrugations. The feed can thus be used effectively only in the vicinity of this frequency and, as a consequence, bandwidths in excess of 100 percent are difficult to obtain.

Other arrangements for transforming the $TE_{11}$ mode into the $HE_{11}$ mode, for subsequent launch from a feed, using helically wound wire structures bonded to the interior surface of a waveguide are disclosed in U.S. Pat. Nos. 4,231,042 issued to R. H. Turrin on Oct. 28, 1980 and 4,246,584 issued to A. R. Noerpel on Jan. 20, 1981.

The problem remaining in the prior art is to provide wide bandwidth hybrid mode feeds which are simpler to fabricate than prior art type feeds with wide bandwidth and also provide negligible reflection and generation of unwanted modes over bandwidths in excess of two octaves.

SUMMARY OF THE INVENTION

The foregoing problem in the prior art has been solved in accordance with the present invention which relates to wide bandwidth hybrid mode feeds and, more particularly, to hybrid mode feeds which are capable of handling very wide bandwidths and include an arrangement which converts a dominant $TE_{11}$ mode at the input to the feed into the $HE_{11}$ hybrid mode, which hybrid mode is then propagated further or launched into free space.

It is an aspect of the present invention to provide hybrid mode feeds which are capable of handling very wide bandwidths wherein the dominant $TE_{11}$ mode is converted to the $HE_{11}$ mode which is then launched. The $TE_{11}$ to $HE_{11}$ mode conversion is achieved by inserting a circular dielectric rod into a flared end of a smooth-walled cylindrical feedhorn until a small cylindrical section of the dielectric rod engages the inner wall of the unflared portion of the feedhorn. In one feed arrangement, the other end of the dielectric rod is similarly inserted into a flared end of a corrugated cylindrical feedhorn section until a short longitudinal section of the cylindrical portion of the rod engages the corrugations of an unflared cylindrical section of the feedhorn to provide a transition for the $HE_{11}$ mode into the corrugated waveguide for subsequent launch. In a second feed arrangement, the dielectric rod at the aperture of the smooth-walled flared feedhorn is spherically flared outward to end in a curved configuration which is preferably shaped to minimize reflections back into the dielectric rod.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
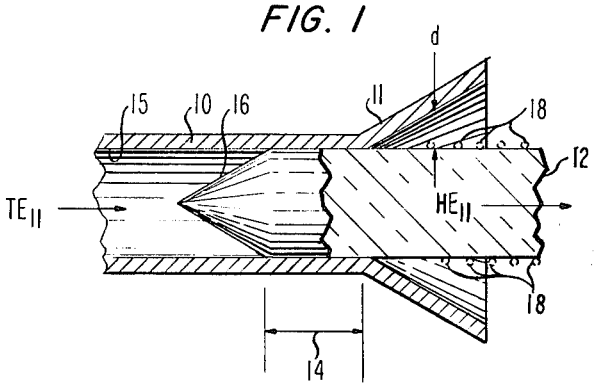
FIG. 1 illustrates a cross-sectional view of the $TE_{11}$ to $HE_{11}$ mode conversion section in accordance with the present invention.

FIG. 1 illustrates a mode conversion arrangement which transforms efficiently, over a wide range of frequencies, the $TE_{11}$ mode into the $HE_{11}$ mode. Such transformation into the $HE_{11}$ mode is desired in order to obtain from a circular feed the radiation characteristics where the field essentially vanishes at the boundary and the field is essentially polarized in one direction. The arrangement of FIG. 1 comprises a circular waveguide 10 which includes an outwardly-flared end section 11, and a rod 12 of dielectric material which has an end section thereof in radial engagement with a longitudinal section 14 of the inner surface 15 of waveguide 10, adjacent the flared end section 11, and extends longitudinally outward from the flared end section 11.

Dielectric rod 12 is shown as comprising a conical end 16 for providing a smooth transition interface for the $TE_{11}$ mode entering dielectric rod 12 from waveguide 10. It is to be understood that such conical end 16 of dielectric rod 12 is preferred but optional and is for purposes of exposition and not for purposes of limitation since other shaped ends such as, for example, a flat end, which is not preferred due to reflections being directed directly backward, or a tapered end could be used to provide a proper transition boundary. Also shown is an optional helical wire structure 18 surrounding dielectric rod 12 in the area both within and beyond the flared end section 11 of waveguide 10, which can be used to improve the performance by containing any of the field found at the boundary.

In operation, the $TE_{11}$ mode propagates from a source (not shown) down waveguide 10 and enters the conical end 16 of dielectric rod 12 and propagates therein until it reaches the beginning of flared end 11 of waveguide 10. It has been found that by placing a dielectric rod 12 inside an ordinary waveguide 10 comprising smooth metal walls, the mode parameter, u, is found to decrease as the distance d between the outer surface of dielectric rod 12 and the inside wall 15 of waveguide 10 is gradually increased. As a consequence, to obtain the $HE_{11}$ mode, starting from the $TE_{11}$ mode, it is sufficient to increase d in the direction of propagation, starting from $d=0$ as shown in FIG. 1 to the end of flared section 11. Beyond the wide end of flared section 11, the distance d is so large that it can be assumed that the $HE_{11}$ mode is guided entirely by dielectric rod 12. Therefore, the metal walls of waveguide 10 and its flared end 11 can be removed especially since, for the $HE_{11}$ mode, the field essentially vanishes at the boundary of dielectric rod 12. The $HE_{11}$ mode can then be propagated further down dielectric rod 12. Optional helical windings 18 merely aid in containing any of the $HE_{11}$ mode at the boundary within rod 12 as stated hereinbefore.

Figure 2:
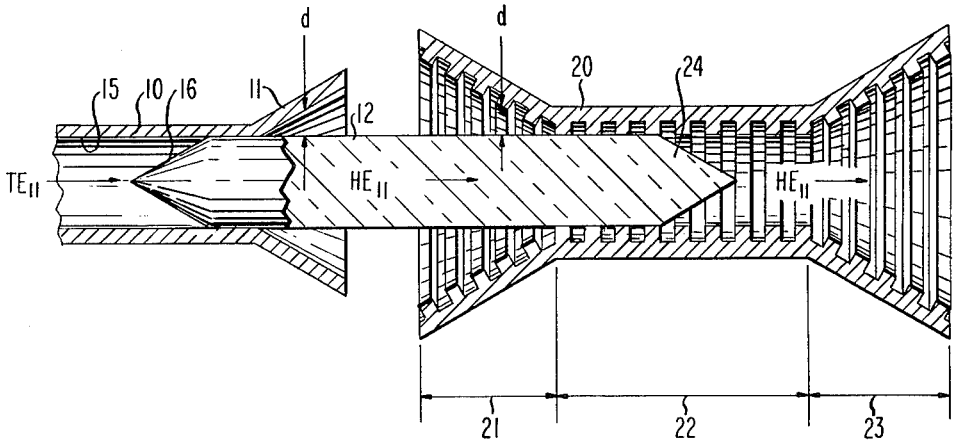
FIG. 2 illustrates a cross-sectional view of a feed arrangement in accordance with the present invention which includes the mode conversion section of FIG. 1.

Having obtained the $HE_{11}$ mode in a dielectric rod 12 as shown in FIG. 1 and described hereinbefore, the ensuing description relates to arrangements which expand the arrangement of FIG. 1 to permit the launching of the $HE_{11}$ mode into free space as found with an antenna feed. One such arrangement in accordance with the present invention is shown in FIG. 2. There, the $HE_{11}$ mode propagating in dielectric rod 12 enters a corrugated waveguide structure 20 comprising a first flared end 21, a cylindrical section 22 and a second flared end 23. More particularly, the $HE_{11}$ mode propagating in dielectric rod 12 enters the first flared end 21 of corrugated waveguide 20 where the distance, d, of the corrugated walls from the dielectric rod 12 is large to prevent reflection or excitation of unwanted modes. In first tapered end 21, the distance d is gradually decreased until the corrugated walls touch the outer periphery of dielectric rod 12. The $HE_{11}$ mode will propagate in first tapered end 21 without conversion to other modes provided $Y \neq \infty$, where $Y = -j\ Z/Z_1, Z$ is the wave impendance of the homogeneous medium filling the waveguide and $Z_1$ is the finite surface impedance in the longitudinal direction of the waveguide. By properly choosing the parameters of the corrugated waveguide, such condition can be satisfied over a very wide frequency range.

On reaching cylindrical corrugated waveguide section 22 the dielectric rod 12 can be terminated in cylindrical section 22 by any suitable configuration as, for example, the conical end 24 shown or other tapered configuration. It can be shown that such arrangement does not result in the generation of unwanted modes, assuming the transition is long enough. The $HE_{11}$ mode then propagates down waveguide section 22 for any desirable distance and is launched into free space, if desired, by second flared end 23 as is well known in the art for providing a smooth transition between a circular waveguide and free space. It is to be understood that the helical wound wire structure 18 of FIG. 1 could be included in the arrangement of FIG. 2 between cylindrical waveguide 10 and the clyindrical corrugated waveguide section 22, which cylindrical waveguide sections should be of a diameter to support the desired frequency range of interest.

Figure 3:
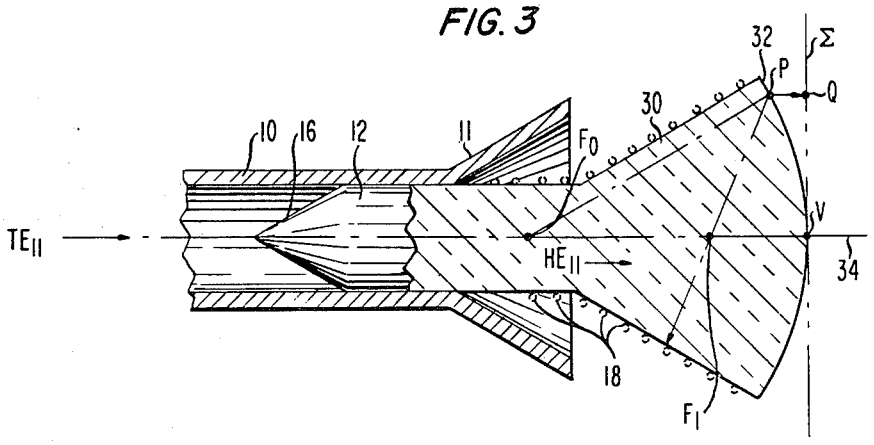
FIG. 3 illustrates a cross-sectional view of an alternative feed arrangement in accordance with the present invention which includes the mode conversion section of FIG. 1.

FIG. 3 illustrates an alternative arrangement for launching the $HE_{11}$ hybrid mode into free space after conversion of the $TE_{11}$ mode into the $HE_{11}$ mode by the arrangement of FIG. 1. There, a horn 30 is formed from dielectric material at the end of rod 12 having an index of refraction, n, appreciably greater than unity. The arrangement of FIG. 3 has the disadvantage that at low frequencies in the GHz range such feed would be large and weighty, but at higher GHz frequencies, e.g., above 18 GHz, the feeds are relatively small and would be attractive because of the simplicity of fabrication.

In the arrangement of FIG. 3, the $TE_{11}$ mode is converted into the $HE_{11}$ mode using the transition of FIG. 1. The $HE_{11}$ mode then enters the dielectric horn section 30 where a spherical wave having essentially the field distribution of the $HE_{11}$ mode propagates inside horn 30 towards the aperture 32. Aperture 32 is shown as a curved boundary of dielectric horn 30. At the aperture 32, because of the discontinuity in the index of refraction, the spherical wave is in part refracted and in part reflected. The reflected wave is undesirable for it causes, inter alia, radiation by the feed in a backward direction. To minimize this effect and also, for example, to obtain a planar wavefront Σ after refraction at the surface of discontinuity at aperture 32 of horn 30, a proper surface configuration must be provided at aperture 32.

To determine the surface configuration to produce a planar wavefront Σ at aperture 32, the wavefront Σ after refraction is next considered. Since in the arrangement of FIG. 3 the spherical wave incident on the surface of discontinuity at aperture 32 originates from the vertex $F_0$ of horn 30, the optical path from point $F_0$ via a point P on the surface of discontinuity to a point Q on wavefront Σ must be a constant. Under such condition it can be shown that an ellipsoid of revolution with one of its foci at vertex $F_0$ and the other focus, $F_1$, disposed such that $|F_1V|(n+1)=|F_0V|(n-1)$, where n is the dielectric refractive index and V is the point at the intersection of the refractive surface 32 and the feedhorn longitudinal axis 34 will provide a refractive surface producing a planar wavefront at aperture 32 of horn 30 after refraction. The wave reflected by the ellipsoidal surface is a spherical wave which converges towards the other focus $F_1$ of the ellipsoid and has essentially the $HE_{11}$ mode pattern. Alternatively, if a spherical wavefront is desired after refraction at aperture 32, instead of a planar wavefront, the surface configuration should be either a spherical configuration with its focus at $F_0$, which is undersirable since all reflected waves are directed right back into waveguide 10, or more generally, a Cartesian oval configuration which approximately focuses the reflected wave towards a focus between point $F_0$ and point V at the aperture. By focusing the reflected waves at a point $F_1$ close to aperture 32, the waves will pass through focus $F_1$ and upon reaching the tapered surface of horn 30, will be partly reflected and partly refracted. The reflected portion will impinge the opposite wall of the tapered section of horn 30 where it will again be partly reflected and partly refracted, and so on. The signal intensity being reflected back into waveguide 10 in this manner will be considerably less than that of a surface of discontinuity which reflects waves directly back to vertex $F_0$.

Figure 4:
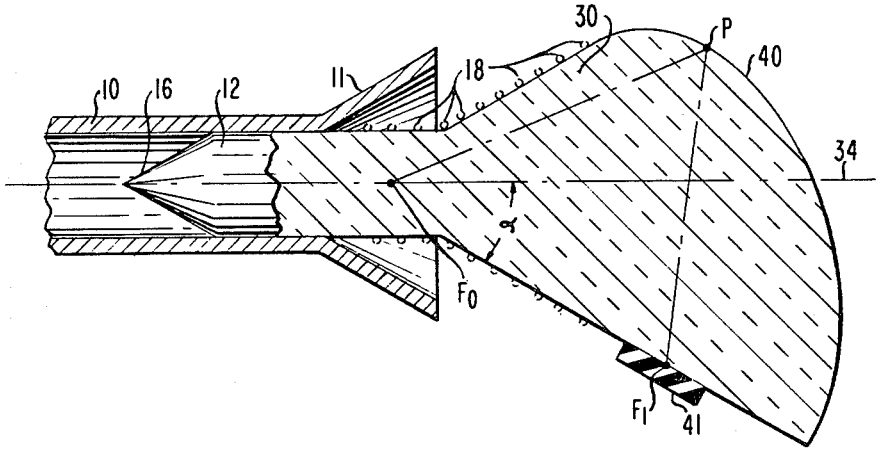
FIG. 4 illustrates a cross-sectional view of the feed arrangement of FIG. 3 which is modified to permit the absorption of reflected waves.

To reduce the magnitude of the resulting reflection coefficient, the arrangement of FIG. 3 can be modified to provide the arrangement shown in FIG. 4 where the ellipsoid axis is offset with respect to the longitudinal axis 34 of horn 30 so that second focus $F_1$ is disposed at the tapered boundary of horn 30. In such arrangement, all spherical waves emanating from vertex $F_0$ are partially refracted and partially reflected at the offset ellipsoid 40 so that the reflected part is focused to focal point $F_1$. Then, by the disposition of absorbing material 41 on the periphery of horn 30 in the vicinity of focal point $F_1$, the reflected wave can be suppressed without greatly affecting the incident wave whose amplitude is small at the boundary. Because of the nonzero angle $\alpha$ between the axes of horn 30 and ellipsoid 40 there will be generated after refraction some cross-polarization components which are essentially the same as the cross-polarization components produced by a feed offset by the same angle $\alpha$. For small angles of horn 30 taper, this cross-polarized component can be suppressed by combining the feed with a suitable arrangement of reflectors as, for example, disclosed in U.S. Pat. No. 4,166,276 issued to C. Dragone on Aug. 28, 1979.

In the arrangements of FIGS. 3 and 4, the dielectric rod 12 and dielectric horn 30 are shown encircled by an optional helically wound wire structure 18 to provide improved performance. Such helical wire structure is, however, only shown for purposes of exposition and not for purposes of limitation since experiments have shown excellent results without the use of a helical wire structure 18.

It is to be understood that in the arrangement of FIG. 2, dielectric rod 12 may not be manufactured to precisely match the inner diameter of smooth walled waveguide 10 and corrugated waveguide section 22. Therefore, in actual construction, a frame (not shown) can fixedly support both waveguides in position rather than depending on a tight fit of dielectric rod 12. In addition, dielectric rod 12 need not correspond to the inner diameter of the corrugated waveguide section 22 which can be slightly greater than the outer diameter of dielectric rod 12, and in such arrangement dielectric rod 12 can then be supported to the corrugations by dielectric washers or spacers (not shown) or held in position by the frame. In such latter arrangement, the $HE_{11}$ mode will still be transferred to corrugated waveguide section 22 provided the tapered end of dielectric rod 12 is sufficiently long.

What is claimed is:

1. A hybrid mode feed arrangement comprising:

a smooth-walled feedhorn comprising a hollow conductive waveguide section (10) for propagating the $TE_{11}$ mode introduced at an entrance of the feedhorn and an outwardly flared conductive end section (11) at an aperture of the feedhorn, both the hollow waveguide and flared end sections including an inner (15) and an outer longitudinal wall surface; and a rod (12) of dielectric material comprising a first end section including an outer wall which symmetrically engages a longitudinal portion (14) of the inner surface of the hollow waveguide section for intercepting the $TE_{11}$ mode propagating in said hollow waveguide section and further extends through the flared end section and beyond the aperture of the feedhorn in a non-contacting arrangement for converting the $TE_{11}$ mode into the $HE_{11}$ mode and propagating the $HE_{11}$ mode therein, and a second end section protruding beyond the aperture of the feedhorn comprising an outwardly tapered horn (30) including a curved aperture at the wide end thereof for launching the $HE_{11}$ mode.

2. A hybrid mode feed arrangement according to claim 1 wherein the curved aperture of the second end section of the dielectric rod comprises a Cartesian oval configuration.

3. A hybrid mode feed arrangement according to claim 1 wherein the curved aperture of the second end section of the dielectric rod comprises a spherical configuration.

4. A hybrid mode feed arrangement according to claim 1 wherein the curved aperture of the second end section of the dielectric rod comprises an elliptical configuration.

5. A hybrid mode feed arrangement according to claim 1 wherein the elliptical configuration of the curved aperture of the second end section is offset in relation to a longitudinal axis of the dielectric rod.

6. A hybrid mode feed arrangement according to claim 5 wherein the offset elliptical configuration at the wide end of the second end section is arranged with a first focal point thereof corresponding with a vertex point of the outwardly tapered second end section and a second focal point thereof being disposed on the tapered boundary of the second end section, the second end section further comprising material capable of absorbing electromagnetic energy impinging thereon disposed on the tapered boundary of the second end section at said second focal point of the elliptical configuration.

7. A hybrid mode feed arrangement according to claim 1 wherein the feed arrangement further comprises:

a helically wound wire structure (18) disposed around the outer wall of the dielectric rod in the area of the first and second end sections which extend through and beyond the aperture of the flared conductive end section of the feedhorn to the curved aperture of the dielectric rod.

* * * * *

Disclaimer 4,468,672.—*Corrado Dragone,* Little Silver, N.J. WIDE BANDWIDTH HYBRID MODE FEEDS. Patent dated Aug. 28, 1984. Disclaimer filed Oct. 22, 1985, by the assignee, *Bell Telephone Laboratories, Inc.*

Hereby enters this disclaimer to claims 1, 4 and 7 of said patent.

[*Official Gazette July 23, 1985.*]